US006926535B2

(12) United States Patent
Tsuji

(10) Patent No.: US 6,926,535 B2
(45) Date of Patent: Aug. 9, 2005

(54) FLEXIBLE HINGE AND A WIRE COVER USING SUCH A HINGE

(75) Inventor: Takeshi Tsuji, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 10/808,011

(22) Filed: Mar. 24, 2004

(65) Prior Publication Data

US 2004/0187258 A1 Sep. 30, 2004

(30) Foreign Application Priority Data

Mar. 25, 2003 (JP) ..... 2003-083166

(51) Int. Cl.[7] ..... H01R 39/00
(52) U.S. Cl. ..... 439/31
(58) Field of Search ..... 439/30, 31, 33, 439/467

(56) References Cited

U.S. PATENT DOCUMENTS 3,272,913 A * 9/1966 Crimmins et al. ..... 174/138 F
4,303,293 A * 12/1981 Grunwald ..... 439/263
5,586,916 A 12/1996 Shinji et al.
6,464,532 B1 * 10/2002 L'Abbate et al. ..... 439/467
6,568,967 B2 5/2003 Inaba et al.
6,780,019 B1 * 8/2004 Ghosh et al. ..... 439/31

FOREIGN PATENT DOCUMENTS

JP 2001-185247 6/2001

* cited by examiner

*Primary Examiner*—Ross Gushi
*Assistant Examiner*—James R. Harvey
(74) *Attorney, Agent, or Firm*—Gerald E. Hespos; Anthony J. Casella

(57) ABSTRACT

A wire cover (1) has a main body (10) and a lid (30) coupled via a bendable hinge (40). A set region (R) is defined between outer ends (Pa, Pb) which spaced from an end (40)*a* of the hinge (40) coupled to the lid (30) and an end (40*b*) thereof coupled to the main body (10) by a specified distance (L) toward a middle part of the hinge (40). A slit (41) is formed in the set region (R) and is not formed at the ends (40*a*, 40*b*) of the hinge (40). Thus, the ends (40*a*, 40*b*) of the hinge (40) are not bent and stress does not concentrate there even if the hinge (40) is bent repeatedly. Thus, cracks and fractures are unlikely to occur at the ends (40*a*, 40*b*).

15 Claims, 8 Drawing Sheets

FLEXIBLE HINGE AND A WIRE COVER USING SUCH A HINGE

BACKGROUND OF THE INVENTION

1. Field of the Invention

The invention relates to a flexible hinge formed with a weakened portion that is easily bendable and a wire cover using such a hinge.

2. Description of the Related Art

U.S. Pat. No. 5,586,916 relates to a wire cover with first and second covers that are coupled by a flexible hinge. Cores of wires are mounted in the first cover. The second cover then is moved by bending the hinge to hold the cores of the wires between the covers.

The flexible hinge should have a rigidity that permits easy bending by hand. Thus, a weakened portion, such as a through hole, has been formed over the entire length of the hinge. The weakened portion facilitates bending. However, stresses are likely to concentrate at opposite ends of the hinge if the hinge is bent frequently. Stress concentrations can lead to cracks and a fracture of the hinge.

The invention was developed in view of the above problem and an object of the invention is to provide a flexible hinge that has a weakened portion that is difficult to crack. Thus, the hinge is not likely to fracture at portions joined with other members. Another object of the invention is to provide a wire cover that uses such a hinge.

SUMMARY OF THE INVENTION

The invention relates to a flexible hinge that has a flexible element with two members that are coupled integrally or unitarily to opposite ends of the flexible element. Thus, the flexible element can be deformed to bring opposite ends of the flexible element into positions to substantially face each other. The flexible element has a weakened portion for making the flexible element easier to bend. The weakened portion is in a set region whose outer ends are spaced inwardly from the opposite ends of the flexible element by a specified distance. Thus, the weakened portion is not at the opposite ends of the flexible element where the flexible element is coupled to the other members. Accordingly, opposite ends of the flexible element are not bent and stress does not concentrate even if the flexible hinge is bent repeatedly. As a result, a crack or a fracture is unlikely to occur at the coupling portions to the other members.

The weakened portion preferably comprises a slit that penetrates the flexible element. Thus, the flexible element can be formed easily without adopting any special process.

The outer ends of the set region preferably are spaced in from opposite ends of the flexible element by about 10% to about 30% of the complete longitudinal extension of the flexible element.

The weakened portion preferably is substantially symmetrical with respect to longitudinal and/or transverse directions of the flexible element.

The thickness of the flexible element preferably is substantially constant.

Widened portions preferably are provided so that the width of the flexible hinge along a transverse direction thereof is gradually widened towards the opposite ends thereof. The widened portions preferably are completely within the specified distance.

The invention also relates to a wire cover that has a main body, a lid that can at least partly close the main body and a flexible hinge that has opposite ends integrally or unitarily coupled to the main body and the lid. The flexible hinge preferably has a weakened portion for making the flexible hinge easier to bend. The lid can close the main body by bending the flexible hinge. Thus, the wire is covered by the main body and the lid. The flexible hinge has the above-described set region with outer ends spaced in from the both ends toward a middle part by a specified distance. The weakened portion is provided in the set region and is not formed in the coupling portions of the flexible hinge to the main body and the lid. Thus, opposite ends of the flexible hinge are not bent and stress does not concentrate on the coupling portions to the main body and the lid even if the flexible hinge is bent repeatedly. As a result, the wire cover can be difficult to crack and fracture.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
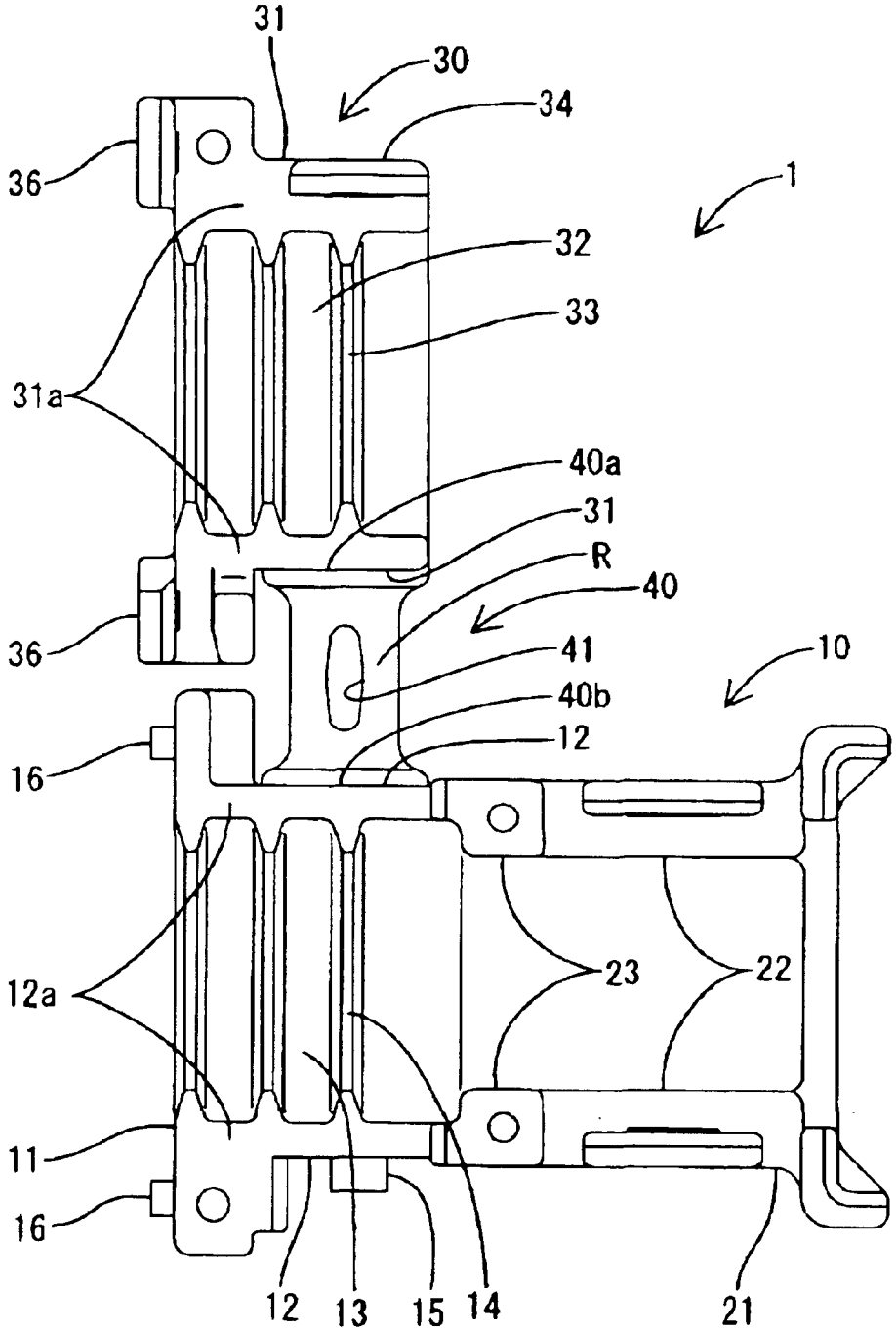
FIG. 1 is a plan view of a wire cover using a hinge portion according to the invention.
Figure 2:
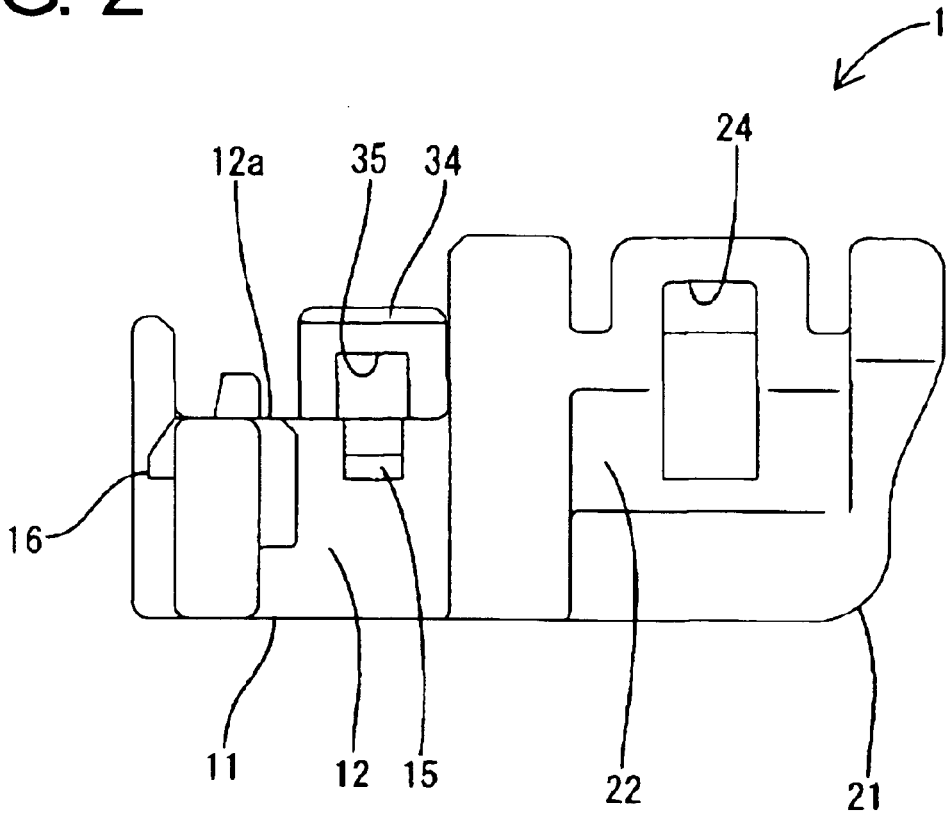
FIG. 2 is a side view of the wire cover of FIG. 1.
Figure 3:
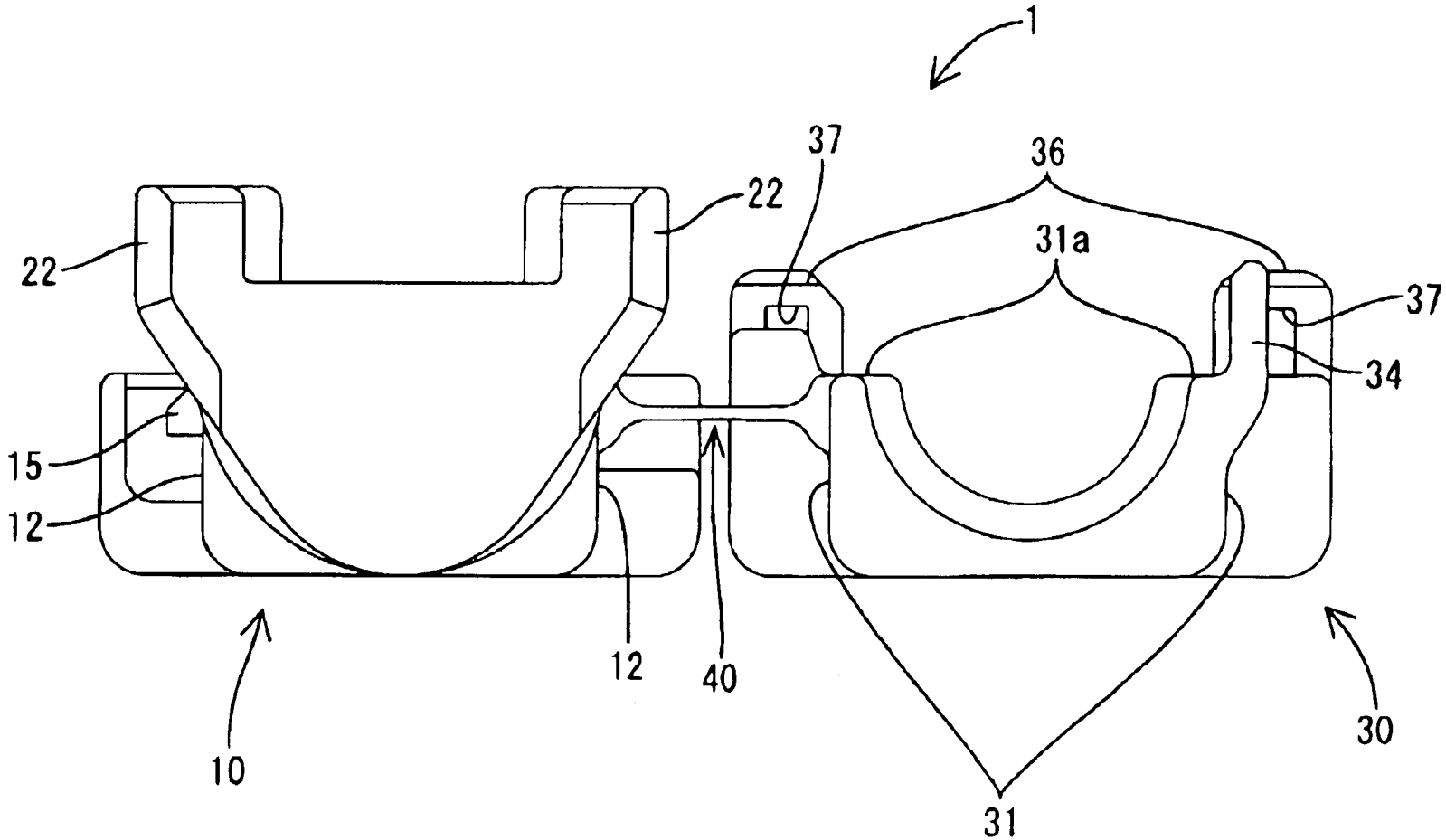
FIG. 3 is a side view of the wire cover of FIG. 2.

A wire cover according to the invention is identified by the numeral 1 in FIGS. 1 to 3. The wire cover 1 has a main body 10, a lid 30, a flexible hinge 40 that couples the main body 10 and the lid 30. As shown in FIG. 3, the main body 10 and the lid 30 have such a shape obtained e.g. by dividing a box into two, and the lid 30 can be put on the main body 10 to close the main body 10 by deforming the hinge portion 40.

Figure 7:
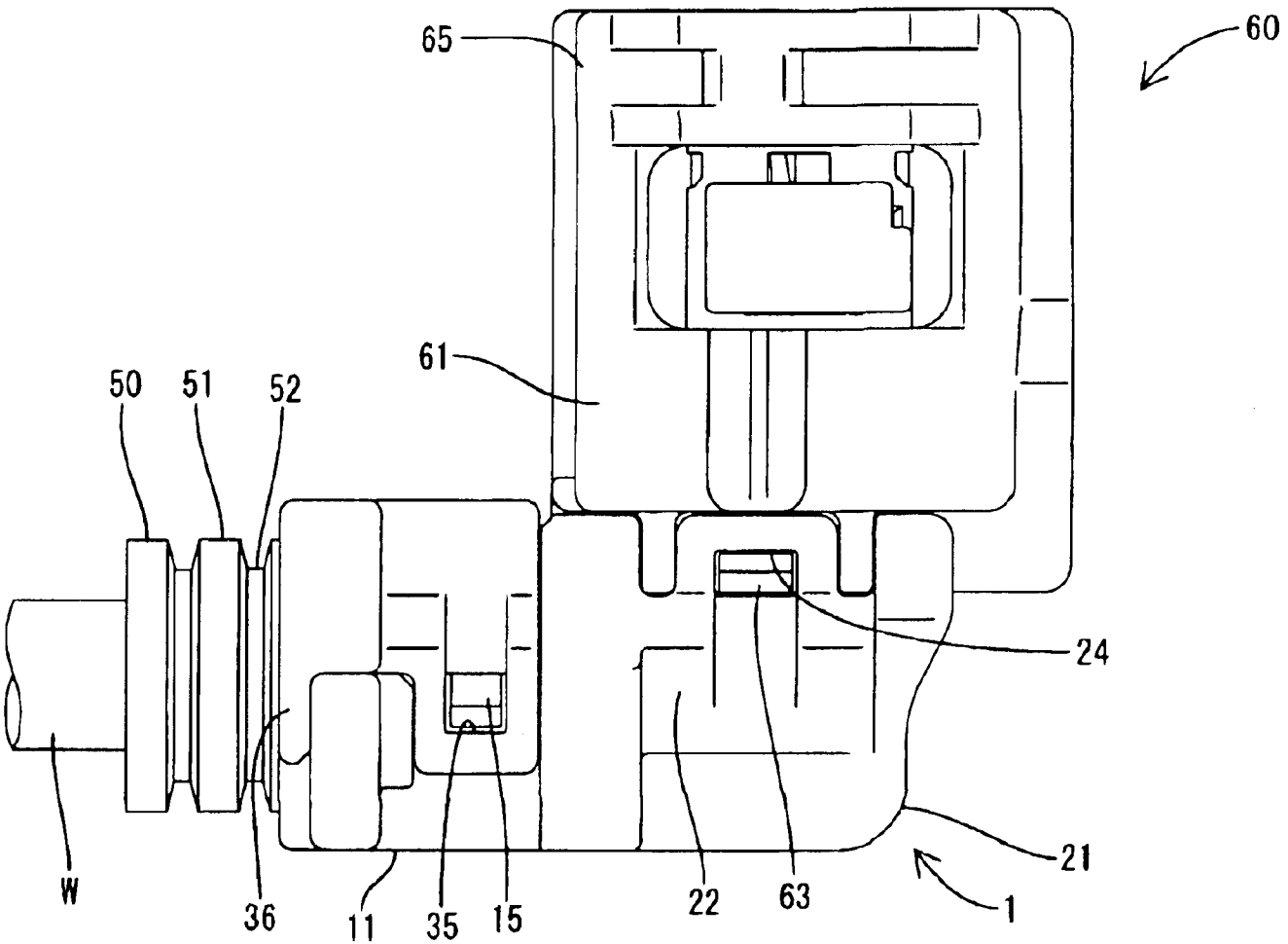
FIG. 7 is a side view showing an assembly of the wire cover and the connector housing.
Figure 8:
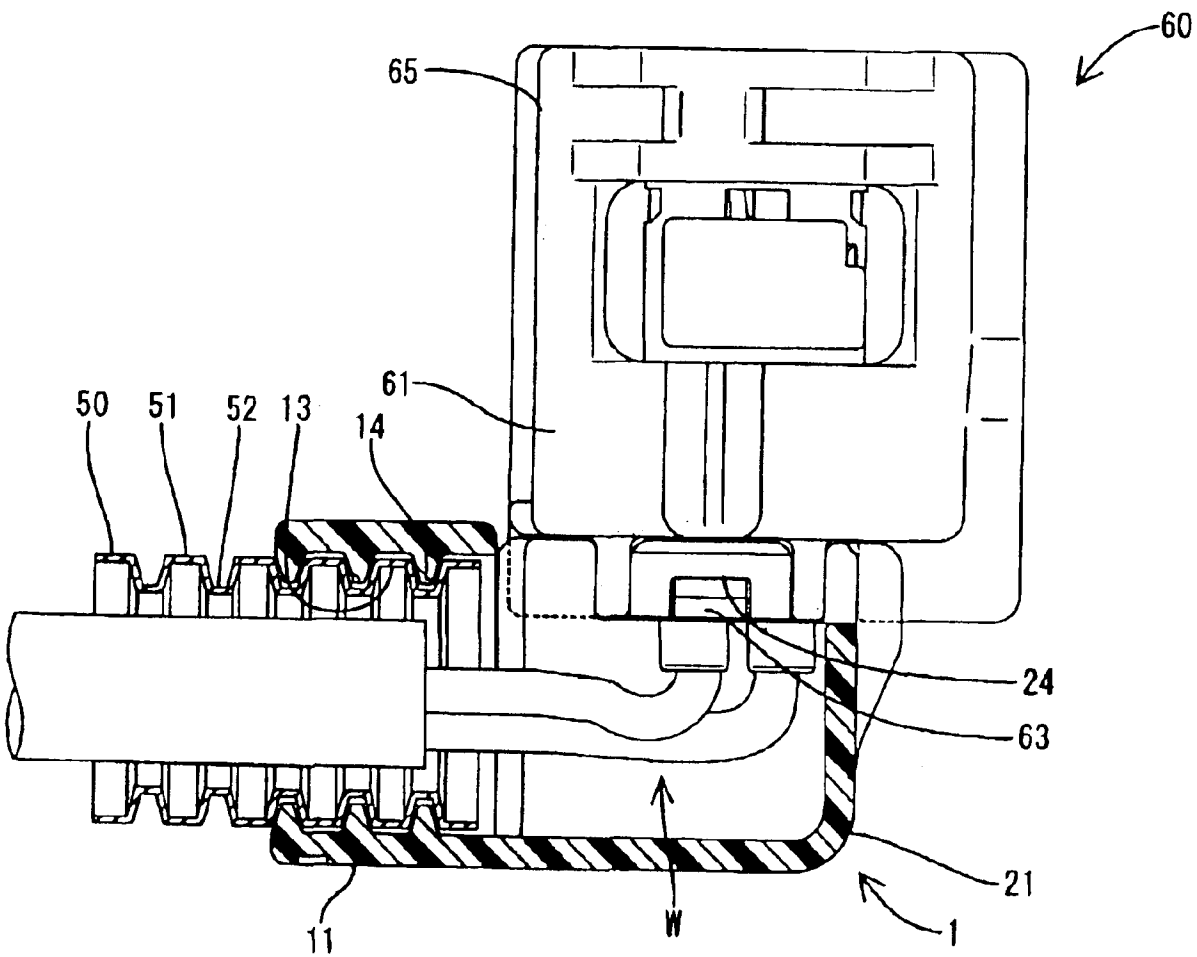
FIG. 8 is a partial section of FIG. 7.

The main body 10 is comprised of a tube holder 11 and a connector coupler 21 that is substantially continuous with the tube holder 11. Two opposed holding sidewalls 12 are formed at the outer circumferential side of the tube holder 11. Upper surfaces of the holding sidewalls 12 define substantially plane surfaces 12*a*, and concave grooves 13 and projections 14 are formed alternately in the inner circumferential surfaces of the holding side walls 12. The grooves 13 and the projections 14 are engageable with elongated projections 51 and recesses 52 of a corrugate tube 50 for protecting wires W shown in FIGS. 7 and 8.

The hinge 40 is coupled unitarily to the outer surface of one holding sidewall 12, and a first engaging projection 15 is formed on the outer surface of the other holding sidewall 12. As shown in FIG. 3, an upper end of the first engaging projection 15 is inclined out to be more distanced from the holding sidewall 12 as it extends down. Additionally, a bottom end of the first engaging projection 15 is substantially horizontal. Two second engaging projections 16 (shown in FIGS. 1 and 2) are formed at the outer circumferential ends of the holding sidewalls 12. As shown in FIG. 2, an upper end of each second engaging projection 16 also is inclined out to be more distanced from the holding sidewall 12 as each engaging projection 16 extends down, and a bottom end of each engaging projection 16 extends substantially horizontally.

The connector coupler 21 has two substantially facing walls 22 that stand up from a bottom. A guide 23 is formed at one end of each wall 22 and is substantially continuous with and slightly lower than the wall 22. A coupling hole 24 is formed in the outer circumferential surface of each of the two walls 22 (only one coupling hole is shown in FIG. 2).

The lid 30 is formed with two substantially opposed lid sidewalls 31 at its outer circumferential side. Substantially plane surfaces 31*a* are formed on the upper surfaces of the lid side walls 31, and concave substantially semicircular grooves 32 and projections 33 are formed alternately in the inner circumferential surfaces of the lid side walls 31 for engaging the elongated projections 51 and the recesses 52 of the corrugate tube 50. The hinge 40 is coupled unitarily to the outer circumferential surface of one lid sidewall 31, and a first engaging piece 34 is formed on the outer circumferential surface of the other lid sidewall 31. The first engaging piece 34 has an engaging hole 35 (shown in FIG. 2) that is engageable with the first engaging projection 15. Further, two second engaging pieces 36 are formed at the outer circumferential ends of the lid sidewalls 31, and each of them is formed with an engaging hole 37 (shown in FIG. 3) that is engageable with a corresponding one of the second engaging projections 16.

Figure 4:
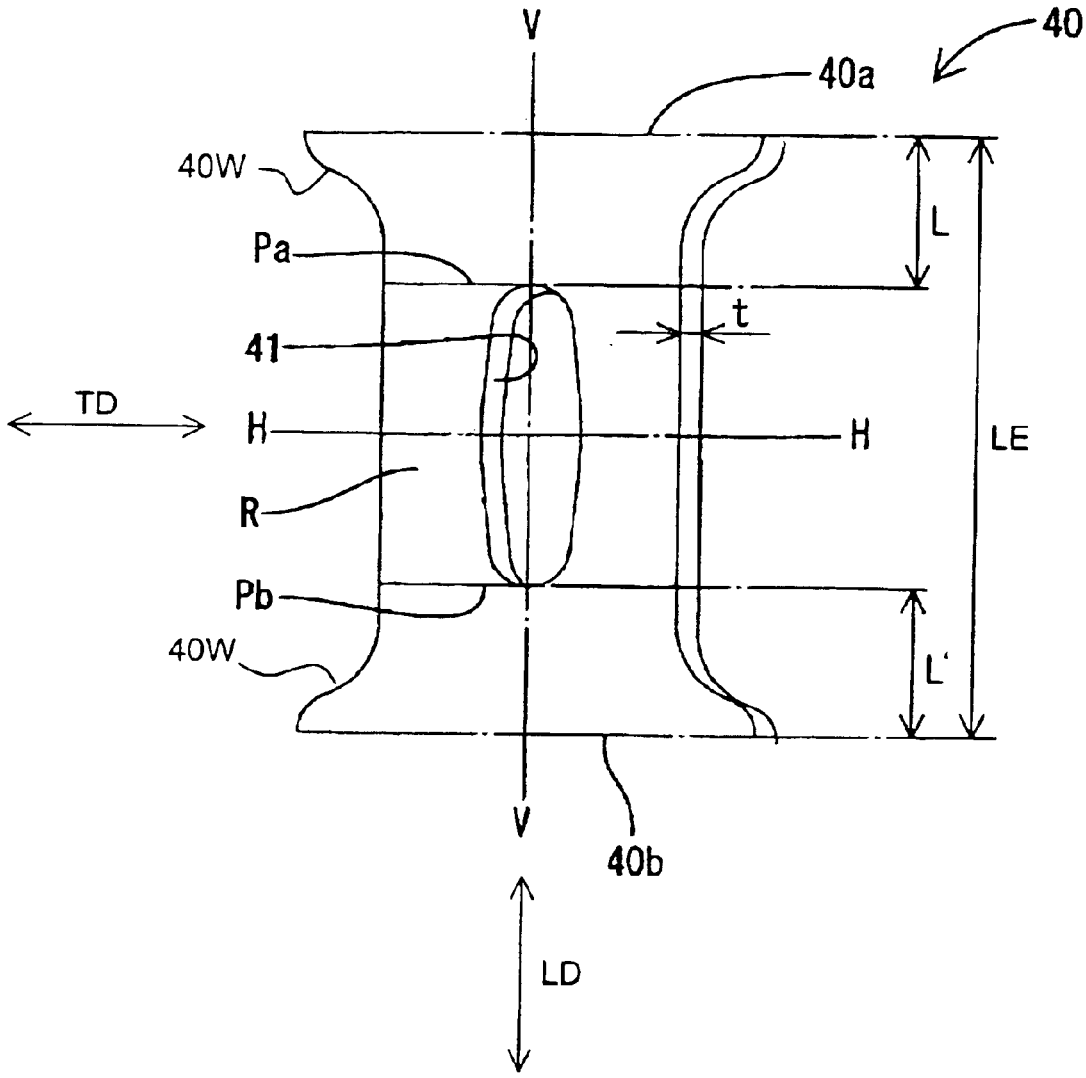
FIG. 4 is an enlarged perspective view of portion of FIG. 1.

The hinge 40 is comprised of a flexible element formed of a synthetic resin, and has a substantially flat shape unitary with the main body 10 and the lid 30. In FIG. 4, thickness t is substantially constant. The lid 30 is coupled to a first end 40*a* of the hinge 40, as shown in FIG. 4, and the main body 10 is coupled to a second end 40*b* thereof. The ends 40*a*, 40*b* come to face each other by bending the hinge 40 to bring the outer ends Pa and Pb of the flexible hinge 40 closer to each other (vertically out of the plane of FIG. 4).

A set region R (shown by hatching in FIG. 4) is defined between positions Pa and Pb. The position Pa is spaced from the first end 40*a* by a specified distance L towards a middle part of the hinge 40 and the position Pb spaced from the second end 40*b* by a specified distance L' towards the middle part of the hinge 40. The positions Pa, Pb are the outer ends of the set region R and the distance L substantially equals the distance L'. A slit 41 is formed completely in the set region R to make the hinge 40 easier to bend. The slit 41 penetrates the hinge 40 and has roughly an oblong or oval shape. High-rigidity regions free from the slit 41 are formed between the first end 40*a* and the position Pa and between the second end 40*b* and the position Pb. Specifically, in this embodiment, the slit 41 is formed substantially at the middle where the hinge 40 is easy to bend and difficult to tear. However, the slit 41 is not at the coupled ends of the hinge 40 to the main body 10 and the lid 30 where the hinge 40 has a high strength and is difficult to bend and easy to break.

The outer shape of the hinge 40 is substantially symmetrical with respect to a first center line H—H passing transversely through the central point of the hinge 40 and also with respect to a second center line V—V passing through the central point of the hinge 40 substantially normal to the first center line H—H, as shown in FIG. 4. The slit 41 is formed substantially at a center position of the hinge 40, and the outer shape of the slit 41 is symmetrical with respect to the first center line H—H and the second center line V—V. Accordingly, the entire hinge 40, including the slit 41, is symmetrical with respect to the longitudinal direction LD thereof and with respect to a transverse direction TD substantially normal to the longitudinal direction LD. Moreover, the width of the hinge 40 along the transverse direction TD gradually widens towards the distal ends 40*a*, 40*b* thereof, and the widened portions 40W are provided within the specified distance L or L'. Accordingly, a wider coupling of the flexible hinge 40 with the main body 10 and the lid 30 is provided, thus improving the coupling strength while maintaining a good bendability of the flexible hinge 40.

Figure 5:
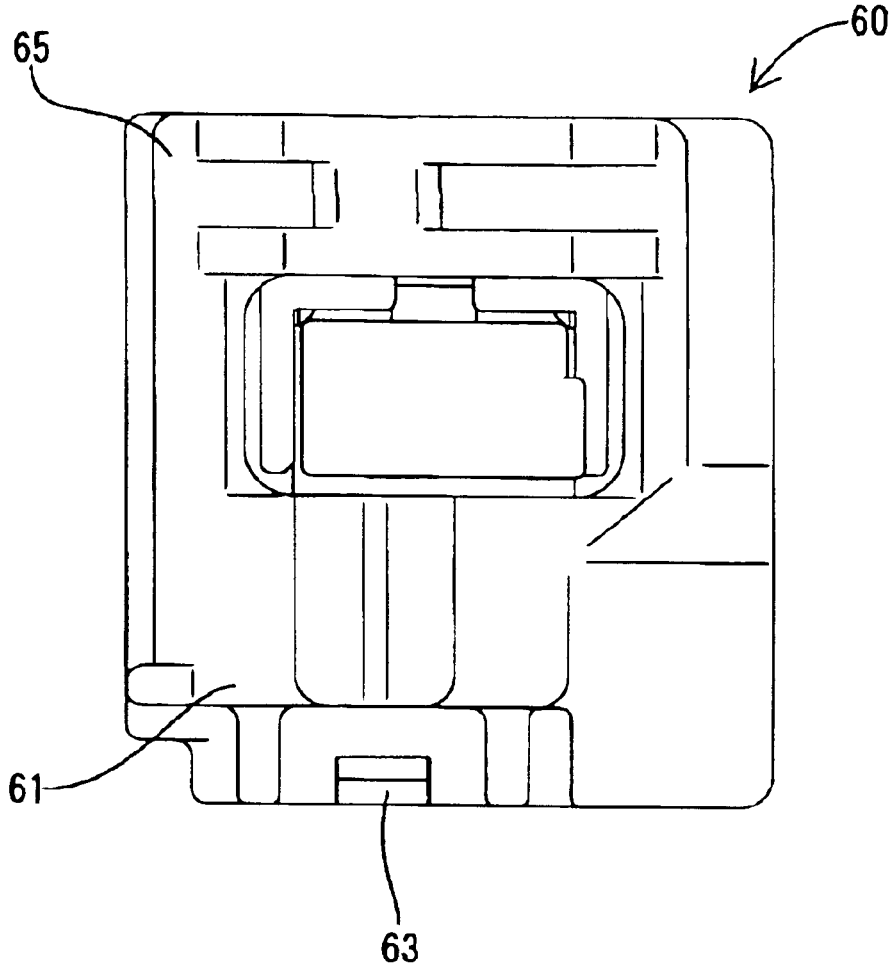
FIG. 5 is a side view of a connector housing to be mounted in the wire cover of FIG. 1.
Figure 6:
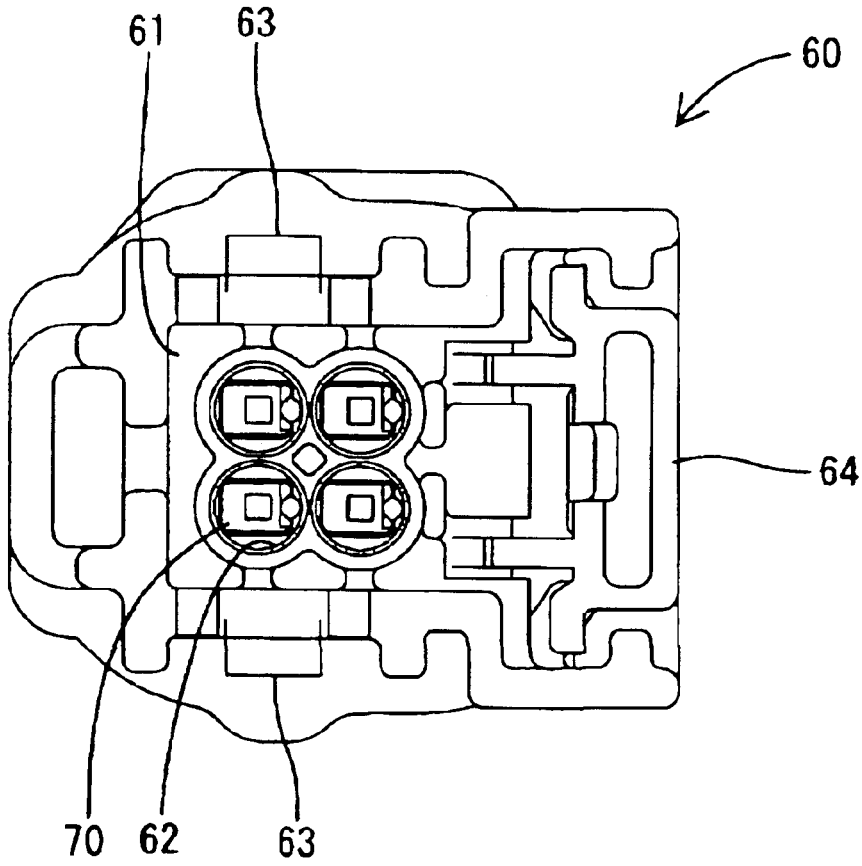
FIG. 6 is a bottom view of the connector housing of FIG. 5.

A connector housing 60 is mounted in the wire cover 1 as shown in FIGS. 5 and 6. The housing 60 has a terminal accommodating portion 61 formed with a plurality of cavities 62 into which terminals 70 coupled to wires W are accommodated. A receptacle 65 is formed continuously and unitarily with the terminal-accommodating portion 61. Coupling projections 63 are formed on the side surfaces of the terminal accommodating portion 61 and are engageable with the coupling holes 24 of the wire cover 1. Each coupling projection 63 has a shape obtained by inverting the first engaging projection 15 of the wire cover 1. Thus, a bottom end of each coupling projection 15 is a slanted surface inclined out in a direction to be more distanced from the side surface of the terminal-accommodating portion 61 as it extends up. An upper portion of the coupling projection is a substantially horizontally extending end surface. The housing 60 also has a locking piece 64 for locking two housings together when the housing 60 is connected with a mating housing (not shown).

A method for mounting the wire cover 1 according to this embodiment is described below. The terminals 70 are connected at the leading ends of the wires W. Additionally, the wires W are introduced into the corrugate tube 50, and the terminals 70 are inserted into the corresponding cavities 62 of the housing 60. The corrugate tube 50 then is placed on the tube holder 11 so that the elongated projections 51 and the recesses 52 of the corrugate tube 50 engage the grooves 13 and projections 14 of the tube holder 11. The lid 30 then is rotated about 180° by bending the hinge 40 of the wire cover 1 substantially around the line H—H. Thus, the lid 30 is put on the main body 10 so that the grooves 32 and the projections 33 of the lid 30 engage the elongated projections 51 and the recesses 52 of the corrugate tube 50. The leading end of the corrugate tube 50 is opposed to the two guides 23 of the wire cover 1 while defining a tiny clearance. Thus, the guides 23 cooperate with the grooves 13 and the projections 14 of the wire cover 1 to prevent displacement of the corrugate tube 50 along longitudinal direction.

The plane surfaces 31*a* of the lid 30 face and substantially engage the plane surfaces 12*a* of the main body 10 when the lid 30 is placed on the main body 10. Thus, the first engaging projection 15 and the second engaging projections 16 of the main body 10 are engaged respectively with the engaging hole 35 of the first engaging piece 34 of the lid 30 and the engaging holes 37 of the second engaging pieces 36 of the lid 30 to fix the lid 30 to the main body 10. As a result, the corrugate tube 50 is covered by the lid 30 and the main body 10 to protect the wires W. The terminal accommodating portion 61 of the housing 60 is fit into the upper end of the connector coupler 21 of the wire cover 1 so that the coupling projection 63 of the housing 60 engages the coupling hole 24 of the connector coupler 21. In this way, the housing 60 is fixed to the wire cover 1 to complete the assembling. It should be noted that the lid 30 of the wire cover 1 may be put on and fixed to the main body 10 after the terminals 70 connected with the wires W are inserted into the corresponding cavities 62 of the housing 60 and the terminal accommodating portion 61 of the connector housing 60 is fit into the upper end of the connector coupling portion 21 of the wire cover 1.

As described above, the slit 41 for reducing the rigidity of the hinge 40 is accommodated completely in the set region R defined between the position Pa spaced from the first end 40*a* by the specified distance L towards the middle of the hinge 40 and the position Pb spaced from the second end 40*b* by the specified distance L' towards the middle of the hinge 40 with the positions Pa, Pb as the outer ends. Portions between the first end 40*a* of the hinge 40 and the position Pa and between the second end 40*b* of the hinge 40 and the position Pb are high-rigidity regions that are free from the slit 41. The distances L and L' preferably are in the range of about 10% to about 30% of the complete longitudinal extension LE of the flexible hinge 40. Even if the hinge 40 is bent repeatedly, the end regions are not bent and, therefore, stress does not concentrate there. As a result, cracks and fractures are not likely to occur at the ends 40*a*, 40*b*. Further, the slit 41 is not formed at the coupled ends of the hinge 40 which have generally a high strength and are difficult to bend and easy to break. Rather, the slit 41 is formed at the middle part of the hinge 40, which is easy to bend and difficult to tear. Thus, the hinge 40 is even less likely to be cracked or fractured. Furthermore, the slit 41 for reducing the rigidity of the hinge 40 preferably penetrates the hinge 40, and hence can be formed easily in the hinge 40 by molding.

The thickness t of the hinge 40 is substantially constant, and the entire hinge 40, including the slit 41, is substantially symmetrical with respect to the longitudinal direction LD and the transverse direction TD. Thus, stress is unlikely to concentrate on one position of the hinge 40 when the hinge 40 is bent. As a result, the hinge 40 further prevents cracking or fracture.

The invention is not limited to the above described and illustrated embodiment. For example, the following embodiments are also embraced by the technical scope of the present invention as defined by the claims. Beside the following embodiments, various changes can be made without departing from the scope and spirit of the present invention as defined by the claims.

The slit formed in the hinge may take any shape such as a right circle, an ellipse, a square, a rectangle or a rhombus.

The weakened portion (having a reduced rigidity e.g. with respect to the portions between the distal ends 40*a*, 40*b* and the portions Pa, Pb) in the hinge does not necessarily have to be a slit penetrating the hinge, and may be a thinned portion formed by partially thinning the hinge.

The outer shape of the hinge, the outer shape of the slit, and/or the position of the slit in the hinge may be asymmetric with respect to transverse or vertical directions.

The hinge also is applicable to devices other than the wire cover.

What is claimed is:

1. A flexible hinge with opposite ends coupled respectively to each of two members and defining a longitudinal direction extending along the flexible hinge between the opposite ends, the flexible hinge being bendable about an axis substantially normal to the longitudinal direction of the flexible hinge for bringing the opposite ends to substantially face each other, the flexible hinge being formed with an elongated weakened portion for making the flexible hinge easier to bend, the weakened portion being in a set region of the flexible hinge, the set region having outer ends spaced in towards a middle part of the flexible hinge from the opposite ends by a specified distance the weakened portion having a length extending substantially parallel to the longitudinal direction of the flexible hinge and a width extending substantially normal to the length, the length being greater than the width.

2. The flexible hinge of claim 1, wherein the specified distance by which the outer ends of the set region are spaced from the opposite ends of the flexible hinge is in a range of 10% to 30% of a complete longitudinal extension of the flexible hinge.

3. The flexible hinge of claim 2, wherein the weakened portion comprises a slit penetrating the flexible hinge.

4. The flexible hinge of claim 1, wherein the weakened portion is substantially symmetrical with respect to the longitudinal direction and a transverse direction substantially normal to the longitudinal direction of the flexible hinge.

5. The flexible hinge of claim 1, wherein widened portions are provided are provided such that a width of the flexible hinge along a transverse direction is widened gradually towards the opposite ends.

6. The flexible hinge of claim 5, wherein the widened portions are provided completely within the specified distance.

7. The flexible hinge of claim 1, wherein the flexible hinge has a substantially constant thickness at all locations spaced from the weakened portion (41).

8. A flexible hinge with opposite ends unitarily coupled respectively to each of two members and defining a longitudinal direction extending between the opposite ends, the flexible hinge further defining a transverse direction normal to the longitudinal direction and a thickness direction normal to the longitudinal direction and the transverse direction, the flexible hinge being bendable about an axis substantially parallel to the transverse direction for bringing the opposite ends to substantially face each other, the flexible hinge being formed with a slit extending entirely through the flexible hinge in the thickness direction and being symmetrically disposed in the flexible hinge relative to both the longitudinal direction and the transverse direction along a set region, the set region having outer ends spaced in towards a middle part of the flexible hinge from the opposite ends by specified distances in a range of 10% to 30% of a complete longitudinal extension between the opposite ends of the flexible hinge, the flexible hinge having a width measured parallel to the transverse direction that gradually increases at locations between the outer ends of the set region and the opposite ends.

9. A wire cover, comprising:

a main body;

a lid configured to close the main body for covering at least one wire between the main body and the lid; and a flexible hinge with a first end coupled to the main body and an opposite second end coupled to the lid so that the flexible hinge defines a longitudinal direction extending between the first and second ends, the flexible hinge having a weakened portion for making the flexible hinge easier to bend, the weakened portion being formed in a set region with outer ends at positions spaced in towards a middle part of the flexible hinge from the opposite ends by a specified distance, the weakened portion having a length dimension extending parallel to the longitudinal direction of the hinge and a width dimension extending substantially normal to the length dimension, the length dimension being greater than the width dimension.

10. The wire cover of claim 9, wherein at least one engaging portion is provided in at least one of the main body and the lid for engaging a portion of a corrugate tube.

11. The wire cover of claim 9, wherein the specified distance by which the outer ends of the set region are spaced from the opposite ends of the flexible hinge is in a range of 10% to 30% of a complete longitudinal extension of the flexible hinge along the longitudinal direction.

12. The wire cover of claim 11, wherein the flexible hinge has thickness direction extending substantially transverse to the length and width dimensions of the weakened portion and wherein the weakened portion comprises a slit penetrating the flexible hinge in the thickness direction.

13. The wire cover of claim 9, wherein the weakened portion is substantially symmetrical with respect to the longitudinal direction and a transverse direction substantially normal to the longitudinal direction of the flexible hinge.

14. The wire cover of claim 13, wherein widened portions are provided such that a width of the flexible hinge along the transverse direction is widened gradually towards the opposite ends.

15. The wire cover of claim 14, wherein the widened portions are provided completely within the specified distance.

* * * * *